United States Patent [19]

Hughes

[11] Patent Number: 4,607,865

[45] Date of Patent: Aug. 26, 1986

[54] CONNECTOR, RATCHETING TYPE

[75] Inventor: David W. Hughes, Houston, Tex.

[73] Assignee: Vetco Offshore Industries, Inc., Ventura, Calif.

[21] Appl. No.: 661,502

[22] Filed: Oct. 16, 1984

[51] Int. Cl.[4] ..... F16L 55/00

[52] U.S. Cl. ..... 285/18; 285/141; 285/321; 285/334; 285/355; 285/392

[58] Field of Search ..... 285/18, 321, 92, 141, 285/333, 334, 355, 390, 392

[56] References Cited

U.S. PATENT DOCUMENTS 3,345,084 10/1967 Hanes et al. ..... 285/321 X
3,721,292 3/1973 Ahlstone ..... 285/18 X
3,893,717 7/1975 Nelson ..... 285/321 X

*Primary Examiner*—Richard J. Scanlan, Jr.

*Attorney, Agent, or Firm*—Joseph R. Dwyer

[57] ABSTRACT

A tieback connector 10 for connecting tieback conductors 14 between a platform and a casing hanger 22 in a subsea well system 20 comprising a split ring 44 on a connector body member 12 having external threads 32 capable of mating with internal threads 24 on the casing hanger 22 and capable of ratcheting over said internal threads 24 as the connector is stabbed into the casing hanger 22. Rotation of the connector 10 will actuate a locking means 54–66 (and 54A–66A) by the combined action of the threads and relative axial movement of said split ring and body member 12 to thread and lock said connector in said casing hanger. An anti-rotation key 50 permits axial relative movement of the split ring 44 and body 12 but prevents relative rotational movement therebetween.

14 Claims, 6 Drawing Figures

84
86
82
74
46
70
62
72
54
64
66
56
60
44
62
64
54
32
66
30
60
62
56
24
54
90
78
94
80
92
78/80
16
76
28
26
12
10
22
34
42
36
36
36
40
38

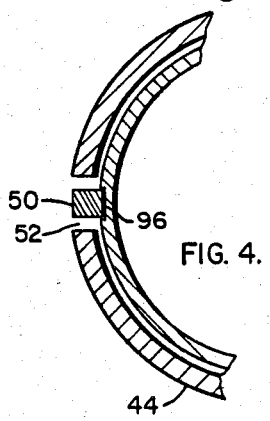
FIG. 4.
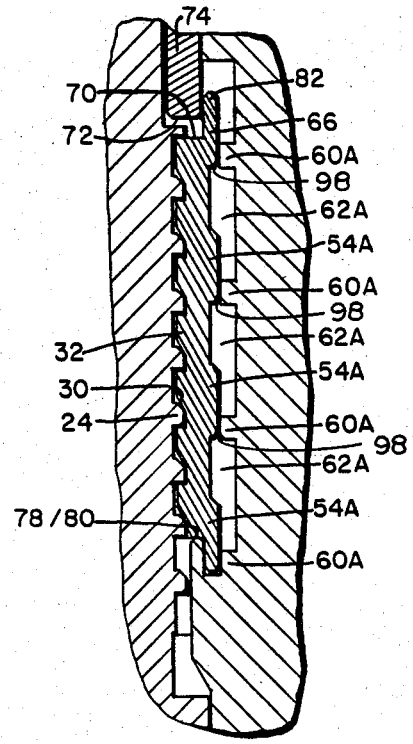
FIG. 6.
FIG. 5.
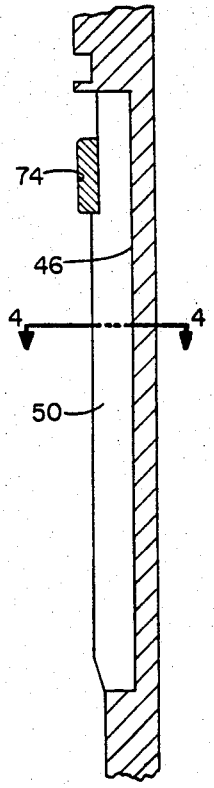

CONNECTOR, RATCHETING TYPE

BACKGROUND OF THE INVENTION

This invention relates, in general, to connectors for joining two tubular members together in axial relationship and, in particular, to a new and improved stab and latch tieback connector of the ratcheting type for use in joining tieback casing to a subsea well system to tieback the subsea well system to a drilling or production platform.

In offshore drilling and production, it is often necessary to connect and disconnect the lower end of a string of joined pipe sections, sometimes referred to as "marine risers" or "strings" of "casing" or "tieback conductors" which connect (tieback) a subsea well system to a floating or stationary platform sometimes referred to as a "rig."

The use of tieback conductors between the drilling or production platform and the subsea well and the need to connect and disconnect the subsea well system at the ocean floor (mudline) and the use of a tieback connector for this purpose is well known.

Present stab and latch tieback connectors, sometimes called "stab tools", connect the riser string by stabbing into the mudline casing hanger of the subsea well system and ratcheting across the internal threads of the casing hanger until the tool is secured within the casing hanger. The present stab tools of this type utilize a split ring having wicker type threads on its outer surface which perform the aforementioned ratcheting action and the ring expands and contracts as it ratchets until fully engaged with the threads of the casing hanger. The reverse taper on the mating faces of the wicker type thread helps eliminate a tendency for the wicker thread to be forced out of contact with the threads of the casing hanger by thread loading caused by tensioning of the riser string, i.e., pulling up on the string at the platform. However, even with such a reverse taper on the threads, disengagement under load is possible, and particularly if standard square shoulder threads are used in the casing hanger.

SUMMARY OF THE INVENTION

The stab and latch tieback connector, which overcomes the problems of present tieback connectors utilizing wicker type threads, comprises a body member having a split ring with threads on its external surface which are capable of ratcheting with the standard square shouldered threads located internally of a casing hanger. The split ring is expandable and contractible to perform the ratcheting action and means are provided for locking the split ring in its expanded condition with the threads overlapping the casing hanger threads when the ring is fully seated in the casing hanger. In one embodiment, this locking means comprises ramped shoulders on the inner surface of the ring which define grooves therebetween which cooperate with ramped shoulders and grooves on the body member. The alignment of the shoulders on the ring with the grooves on the body member allows the ring to contract during the ratcheting action, but when the tieback tool is fully landed, rotation of the body member to thread the ring on the casing hanger threads will move the ring downwardly relative to the body member to lock the ring radially outwardly in tight full overlapping threaded engagement. To unlock and retrieve the connector, the body member is simply rotated in the opposite direction to unthread the body member out of the casing hanger.

In another embodiment, the locking means comprises simply shoulders on the inner surface of the ring which define grooves therebetween, and which cooperate with grooves and shoulders on the body member. The ramps are eliminated and the tops of the shoulders engage to lock the ring radially outwardly.

It is therefore an object of this invention to provide a stab and latch type tieback connector with a positive lock between the tieback connector and the well system.

Still another object of this invention is to provide a stab and latch type tieback connector with threads which ratchet similar mating threads on a component of a well system eliminating the need for wicker type threads.

It is also pointed out that while this invention is disclosed as a tieback connector, it will be apparent to those skilled in the art that this invention can be incorporated and any device where ratcheting threads are used; the U.S. Patent to Ahlstone, No. 3,721,292 where ratcheting type threads are used in a marine riser system, being but one example. It should also be apparent that the tieback connector and casing hanger suggest the so-called pin and box connection for joining pipes together coaxially and those skilled in the art will recognize that this invention can be used in such connections.

BRIEF DESCRIPTION OF THE DRAWINGS

FIG. 1 is an elevational view of the tieback connector of this invention, together with a sectional view of a casing hanger, FIG. 2 is a cross sectional view, enlarged over that of FIG. 1, to more clearly show the split ring, the outer threads thereof, the first embodiment of the locking means, i.e., the ramped shoulders on the split ring and body member with the portion of the split ring relative to the body member after the split ring has ratcheted into the casing hanger but before the tieback connector is finally locked in, FIG. 3 illustrates the tieback connector fully threaded and locked in the casing hanger, FIG. 4 is a cross-sectional view of part of the tieback connector illustrating the position of the anti-rotation key, FIG. 5 is a view of the anti-rotation key in the connector, and FIG. 6 is a cross-sectional view of a second embodiment of the locking means of this invention shown in locked position.

DETAILED DESCRIPTION

Figures 1, 2, 3:
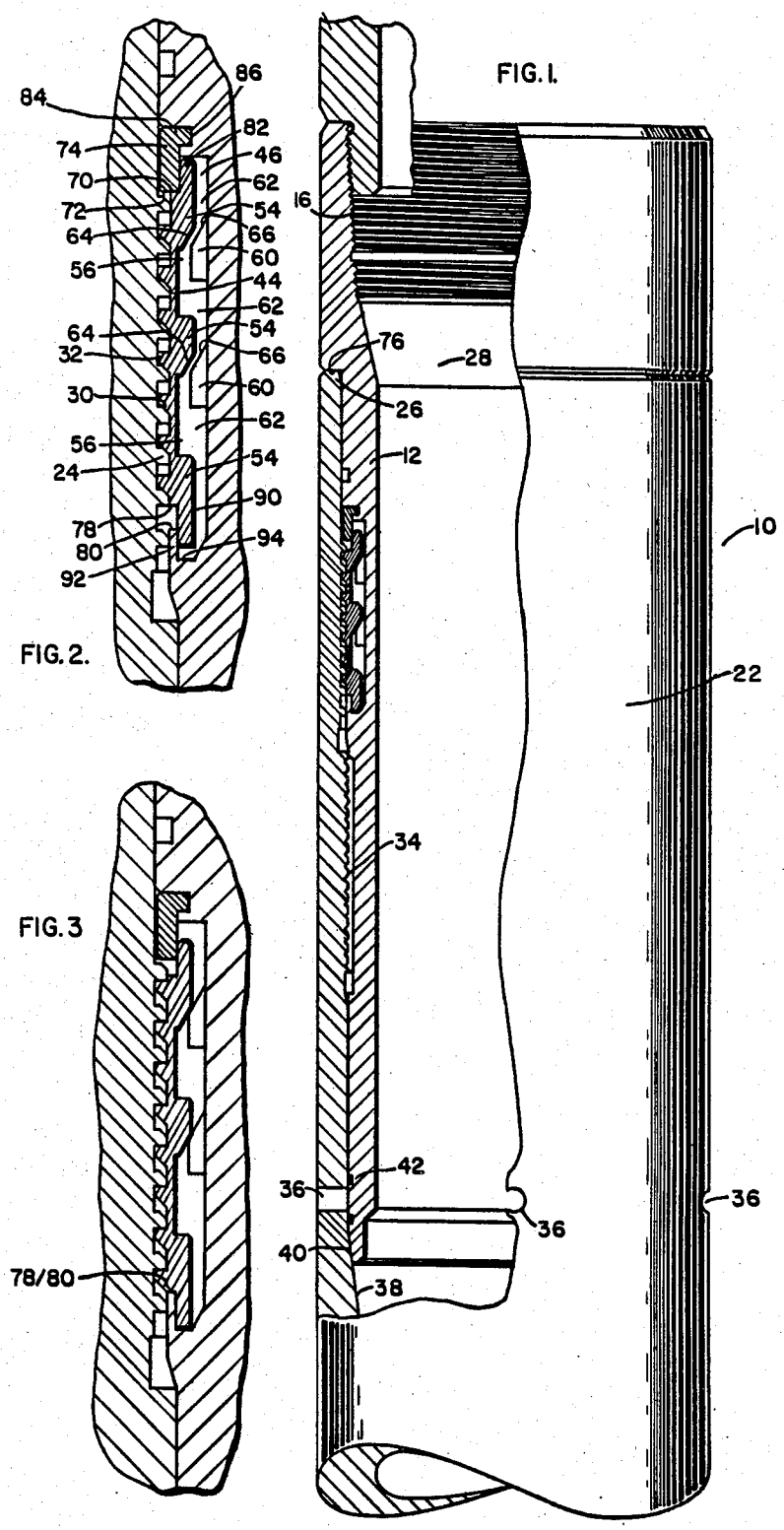

FIG. 1 illustrates the snap and latch tieback connector of this invention, identified in its entirety as 10, and comprising a hollow tubular body member 12 connected to the lower one of a string of casing 14 by conical threads 16 and a casing hanger 22, also a hollow tubular member in a well system (not shown). The purpose of the tieback connector is to latch the casing 14 to the well system thus "tieing back" the well to the platform or rig. Though not shown, the casing hanger 22 supports casing in the well system which are cemented in previously drilled holes in a conventional manner. The casing hanger 22 is conventionally provided internally with square shouldered threads 24 located a short distance below an upper edge 26 which defines the throat 28 of the casing hanger. In some casing hangers, the threads are provided with a slight chamfer 30 on their upper edges and it is this latter type thread which is illustrated herein.

In practice, the tieback connector 10 will enter the throat 28 of the casing hanger 22 and external threads 32 in the connector will engage the casing hanger threads 24 in a ratcheting action until the connector is seated in the casing hanger (see FIG. 2). The casing hanger is also provided with an additional set of threads 34 which are used to connect another running tool or tieback connector (not shown) in the event that the threads 24 become damaged. Below these latter threads there is typically provided a plurality of wash ports 36, which in the embodiment shown, are only slightly above a conical upwardly facing landing surface 38. This landing surface will be engaged by the nose of the tieback connector formed with a conical taper 40. The nose is also provided with a pair of spaced apart O-ring seals 42 located in suitable grooves to seal the wash ports 36 when the tieback connector is fully landed.

To accomplish the ratcheting action, the tieback tool is provided with a peripheral axially split ring 44, sometimes referred to as a C-ring, located substantially midway of the body member 12 and suitably fixed in a peripheral main groove 46 in the body member. To allow expansion and contraction of the split ring as the ratcheting action takes place, the main groove 46 is deeper than the inner diameter of the ring and is also longer than the width of the split ring to allow axial movement of the split ring relative to the body member. An anti-rotation key 50 is located in the space 52 provided by the axial separation of the split ring and is suitably affixed to the body member to prevent relative rotation between the C-ring and body member. The width of the space 52 is greater than the width of the key 50 to allow contraction of the split ring.

It is the outer surface of the split ring that is provided with above mentioned threads 32 formed to mate with the threads 24 in the casing hanger. These threads 32 extend radially outwardly of the adjacent edges of the tieback connector to provide suitable overlap with the casing hanger threads 24 and the expansion and contraction of the split ring perform the ratcheting action. As previously mentioned, the split ring 44 and body member together function to lock the split ring in its fully expanded condition at the appropriate time, i.e., when the ratcheting action has fully taken place, to lock the tieback connector to the casing hanger. To accomplish this locking function in the first embodiment of the invention, the inner surface of the split ring is provided with a plurality of radially inwardly projecting concentric shoulders 54 (three shown) to define a plurality of grooves 56 (two such grooves being shown). The top and bottom shoulders 54 are formed as part of the retaining means for the ring which will be described hereafter. Similarly, the body member is provided with radially outwardly projecting concentric shoulders 60 (two shown) also defining a plurality of grooves 62 (three shown). Two of the shoulders 54 are conically tapered to define surfaces 64 facing downwardly which match conically tapered upwardly facing surfaces 66 on the shoulders 60. These surfaces 64 and 66 form ramps or inclined planes by which the split ring will become locked in its outward position. While on the embodiment shown the shoulders 60 are formed on the body member itself, a separate ring with such shoulders may be used as a matter of choice of manufacturing techniques.

Thus, before the tieback connector is stabbed into the casing hanger, a radially outwardly extending upwardly facing shoulder 70 on the ring is in engagement with a downwardly facing radial shoulder 72 of a second ring 74, a retaining ring, and the threads 32 of the split ring are capable of ratcheting over the threads 24 in the casing hanger due to the alignment of the shoulders 54/60 and grooves 56/62.

When the tieback tool is landed, that is, when the nose of the tieback connector engages the casing hanger landing surface 38 and possibly when the shoulder 76 on the tieback connector engages the top edge 26 on the casing hanger, threads 32 and 24 on the split ring and the casing hanger, respectively, are overlapped. The position of the split ring having been selected to conform to the position of the internal threads on the casing hanger to allow full interface of the respective threads. At this point, the tieback connector is rotated by rotation of the casing string 14 threading the ring further downwardly into the casing hanger and moving the ring relative to the body member. This threading action causes the split ring to disengage the shoulders 70 and 72 and cause engagement of a downwardly facing shoulder 78 on the split ring with an upwardly facing radial shoulder 80 on the body member. At the same time, inclined planes 64 of shoulders 54 engage and ramp up the inclined planes 66 of the shoulders 60 urging the threads 32 to a more overlapped and locked position with the threads 24 of the casing hanger. In the event that the shoulder 76 near the upper end of the tieback connector did not engage the edge 26 of the casing hanger, the rotation of the tieback connector and the threading action of the split ring will cause such engagement.

To lock the upper end of the split ring onto the body member, the upper end of the split ring is provided with an integral retaining means in the form of a circumferentially thin retaining ring 82 offset inwardly with respect to the main portion of the split ring. The offset of this ring 82 also provides the shoulder 54 and its ramp 64 as above explained. This ring 82 telescopes within the above mentioned second ring 74 on the body member. This second ring 74 is provided with a radially inwardly directed circumferential positioning lip 84 which seats in a complimentary peripheral groove 86 in the body member. This second ring extends downwardly over the top of the main groove with the ring 82 serving to retain the upper end of the split ring in place. This second ring also provides the stop means 72 previously mentioned. This second ring is suitably fixed in place, preferably by welding, on the body member after the split ring and anti-rotation key are in position.

To lock the lower end of the split ring onto the body member, a second retaining means in the form of a integral downwardly extending circumferential thin retaining ring 90 is formed on the split ring offset inwardly like the retaining ring 82 which telescopes behind an upwardly extending thin lip 92 formed in the body member by an undercut 94 as an extension of the main groove. The upper edge of the lip 92 is upwardly facing and defines the above mentioned surface 80 for the split ring in its lower position. Thus, the split ring is retained, both top and bottom, by a telescoping arrangement but is free to move axially with respect to the body member.

To retain the anti-rotation key in place, the body member is provided with an axial groove 96 which extends the length of the main groove, behind the second ring and into the undercut 94. Thus, the undercut 94 and second ring serve not only to hold the split ring in place, but also to hold the anti-rotation key in place without the need of other fastening devices. During assembly both the split ring and anti-rotation key are inserted into the undercut 94, the split ring also being inserted in the axial groove 96 and then the second ring 74 is placed on the body member and welded in place.

In the second embodiment of the locking means, shown in locked position in FIG. 6, the inner surface of the split ring is provided with concentric radially inwardly directed shoulders 54A which define concentric grooves 56A which cooperate with concentric shoulders 60A and concentric grooves 62A therebetween. These shoulders and grooves cooperate in almost the same manner as the grooves and shoulders of the first embodiment and are therefore given the same reference numerals as in the prior Figures for simplification and clarity. In this embodiment, however, the tops or crowns of the shoulders 54A and 56A will engage (abut) to hold the ring radially outwardly. The function of the ramps as the final locking elements are eliminated with only chamfers 98 being used to facilitate the movement of the shoulders into abutting relationship. It is apparent to those skilled in this, however, that in the first embodiment the ramps act to urge the ring outwardly with the overlap of the engaging threads 24 and 32 being the limiting factor, whereas in the second embodiment the radial dimension of the shoulders 54A and 60A is the limiting factor. Thus, the desired overlap of the threads 24 and 32 in the final locked position will be factored into the design of the shoulders 54A and 60A.

From the foregoing it can be seen that a new and improved connector device has been disclosed utilizing a split ring which does not require special threads since the only requirement is that the threads are capable of mating with the internal threads of the device to which the connector is to be connected and utilizing a specialized type of tongue and groove arrangement to lock the threads tightly in engagement thus minimizing the possibility of disconnection of the joined devices.

I claim:

1. A tieback connector for connecting a tieback conductor between a platform and a well system where the latter includes a hollow tubular member with internal threads for threadably receiving said connector, said connector comprising, a hollow tubular body member connected to one of said tieback conductors, a split ring positioned circumferentially of said body member with its inner wall and top and bottom ends spaced from said body member for limited radial expansion and contraction of said split ring and for limited axial movement of said split ring relative to said body member, means between said split ring and body member whereby rotation of said body member also rotates said split ring, external threads on said split ring capable of mating with said internal threads and also capable of ratcheting by expansion and contraction of said split ring over said internal threads when said connector is inserted into said well system, said ratcheting occurring until said body member reaches a predetermined position within said well system whereupon said threads overlap, and means to lock said connector in said well system by the combined action of rotational and axial movement of said split ring.

2. A tieback connector as claimed in claim 1 wherein said last mentioned means includes a tongue and groove arrangement on said split ring and said body member.

3. The tieback connector as claimed in claim 2 wherein said tongues have matching inclined planes and wherein said tongues on said ring ramp up the respective inclined planes on said body member when said split ring is rotated due to the cooperative action of the inter-engaging threads.

4. The tieback connector as claimed in claim 3 further including a first stop means which is engaged by said split ring when said connector is ratcheting in said well system and a second stop means which is engaged by said split ring when said split ring is rotated to its final position, said stop means being positioned such that said split ring is moveable axially relative to said body member to ramp up said inclined planes.

5. The tieback connector as claimed in claim 4 wherein said split ring has retaining means on each edge thereof which telescopes within matching retaining means on said body member to retain said split ring on said body member.

6. The tieback connection as claimed in claim 2 wherein said tongues have flat concentric surfaces which abut when said split ring is rotated due to the cooperative action of the interengaging threads.

7. The tieback connector as claimed in claim 6 further including a first stop means which is engaged by said split ring when said connector is ratcheting in said well system and a second stop means which is engaged by said split ring when said split ring is rotated to its final position, said stop means being positioned such that said split ring is moveable axially relative to said body member.

8. The tieback connector as claimed in claim 1 wherein said split ring has retaining means on each edge thereof which telescopes within matching retaining means on said body member to retain said split ring on said body member.

9. A connector for joining two pipe means together coaxially, the first of said pipe means having internal threads near one end thereof and adapted to receive the second pipe means in a telescoping relationship, the second pipe means including, an externally threaded split ring located externally of said second pipe means and spaced from the latter's outer end a corresponding distance so that said external threads will axially coincide with said internal threads when said second pipe is inserted into the first pipe, said external threads being capable of ratcheting over said internal threads as said second pipe is inserted into said first pipe by the contraction and expansion of said ring so that said threads overlap when said second pipe reaches a predetermined position in said first pipe, said split ring being at an expanded position when said threads overlap and being deflectable inwardly during ratcheting, means preventing relative rotation of said split ring and said second pipe but allowing axial relative movement therebetween, and means for locking said split ring in said expanded position thus locking said second pipe in said first pipe.

10. The connector as claimed in claim 9 wherein said locking means comprises inclined planes extending radially inwardly of said split ring, and inclined planes extending radially outwardly of said second pipe and cooperable such that said inclined planes engage urging the split ring outwardly when said second pipe is rotated and threaded on the internal threads of said first pipe.

11. The connector as claimed in claim 10 wherein said split ring is in a first position as said second pipe is inserted into said first pipe and during said ratcheting action and wherein said ring is moveable to a second position when said second pipe reaches the aforesaid predetermined position after which said second pipe is rotated to activate the engagement of said inclined planes.

12. The connector as claimed in claim 11 further including means preventing relative rotation of said split ring and said second pipe but allowing axial relative movement therebetween.

13. The connector as claimed in 9 wherein said locking means comprises shoulders extending radially inwardly of said split ring, and shoulders extending radially outwardly of said second pipe and cooperable such that tops of said shoulders engage urging the split ring outwardly when said second pipe is rotated and threaded on the internal threads of said first pipe.

14. The connector as claimed in claim 13 wherein said split ring is in a first position as said second pipe is inserted into said first pipe and during said ratcheting action and wherein said ring is moveable to a second position when said second pipe reaches the aforesaid predetermined position after which said second pipe is rotated to activate the engagement of said planes.

* * * * *